US005404657A

United States Patent [19]

Honeycutt

[11] Patent Number: 5,404,657

[45] Date of Patent: Apr. 11, 1995

[54] FOOT AND SHOE PROTECTOR

[76] Inventor: Larry W. Honeycutt, P.O. Box 86, Concord, N.C. 28026

[21] Appl. No.: 74,198

[22] Filed: Jun. 9, 1993

Related U.S. Application Data

[63] Continuation of Ser. No. 831,470, Feb. 5, 1992, abandoned.

[51] Int. Cl.[6] ..... A43B 19/00

[52] U.S. Cl. ..... 36/10; 36/9 R; 36/11.5

[58] Field of Search ..... 36/9 A, 11.5, 9 R, 10

[56] References Cited

U.S. PATENT DOCUMENTS

| | | | |
|---|---|---|---|
| 1,494,253 | 5/1924 | Karrer et al. . | |
| 1,544,578 | 7/1925 | Henderson | 36/11.5 |
| 1,686,975 | 10/1928 | Lawson | 36/9 A |
| 1,817,623 | 8/1931 | Hervey | 36/9 A |
| 2,210,475 | 8/1940 | Trimble | 36/9 A |
| 2,276,582 | 3/1942 | Krevis | 36/9 A |
| 2,288,199 | 6/1942 | Levy | 36/10 |
| 2,614,341 | 10/1952 | Abbott | 36/9 A |
| 2,943,403 | 7/1960 | Meister | 36/9 A |
| 2,952,926 | 9/1960 | Laven | 36/11 |
| 3,417,408 | 12/1968 | Caggiano | 2/239 |
| 4,571,851 | 2/1986 | Yamada | 36/9 A X |

*Primary Examiner*—Paul T. Sewell
*Assistant Examiner*—Ted Kavanaugh
*Attorney, Agent, or Firm*—Rhodes, Coats & Bennett

[57] ABSTRACT

A foot and shoe protector. The protector includes an enclosed toe portion shaped to substantially conform to and incase the toe area of a foot and a generally rectangular heelless sole portion attached along one edge to the enclosed toe portion. The heelless sole portion extends beyond the edges of the toe portion to form a pair of flaps for preventing contact between the upper edges of the shoe and the foot.

15 Claims, 2 Drawing Sheets

FOOT AND SHOE PROTECTOR

This application is a continuation of application Ser. No. 07/831,470 filed Feb. 5, 1992, now abandoned.

BACKGROUND OF THE INVENTION (1) Field of the Invention

The present invention relates generally to footwear and, more particularly, to a one-piece disposable thin film envelope-like device useful for a foot and shoe protector for customers when trying on new shoes in a shoe store prior to purchase.

(2) Description of the Prior Art

During the normal course of the business in a shoe store, shoes are tried on by the customer. However, the frequent trying-on of new shoes eventually soils and often damages the insides of the shoes so that soon they cannot be sold as new shoes. The soiling damages the new shoes being tried on in the store even with a sock, stocking or uncovered customer's foot and will eventually result in new shoe damage because customers' socks, stockings or feet are to varying degrees unclean due to perspiration, dirt or diseases of the feet such as athlete's foot. Thus, each new shoe tried on and not purchased will subsequently be tried on another purchaser who is then subjected to any unclean matter or disease conditions left by the former prospective purchasers.

U.S. Pat. No. 2,952,926 (issued to Leven) discloses a disposable shoe protector formed of a tissue-thin material such as transparent non-absorbent polyethylene. The foot covering is formed in the shape of a slipper or moccasin which is slipped on by the user prior to trying on the shoe.

U.S. Pat. No. 2,288,199 issued to Levy is directed to a device for protecting the toe area and portion of the foot against contact with the shoe or the bodies external of the protector with contact against disease germs especially against disease germs commonly known as athlete's foot. The foot protector as taught by Levy consists of a relatively thin elastic non-porous material which is shaped to readily conform to encase the toe area and forward portion of the foot.

U.S. Pat. No. 3,417,408 issued to Caggiano discloses a disposable foot cover having a toe portion and heel portion and ankle portion and lower leg portion, each of the portions having perforations therein and a predetermined pattern to facilitate an alteration in the form of the footwear.

Certain disadvantages become apparent from a review of the above references. Specifically, the Leven and Caggiano devices must be formed in a variety of sizes in order to fit different size feet of those persons trying on the shoes. In addition, the device taught by Levy only provides protection for the forward and bottom portions of the wearer's foot. Thus, there remains a need for a new and improved foot and protector which is adapted to fit all or mostly all sizes of wearers while, at the same time, also providing superior protection to the sides of the wearer's foot.

SUMMARY OF THE INVENTION

The present invention is directed to a foot and shoe protector which includes an enclosed toe portion shaped to substantially conform to and incase the toe area of a foot and a generally trapezoidal heelless sole portion attached along one edge to the enclosed toe portion. In the preferred embodiment the protector is formed from a recyclable nonporous material such as polyethylene plastic. The heelless sole portion attached along one edge to the enclosed toe portion extends beyond the edges of the toe portion to form a pair of flaps for preventing contact between the upper edges of the shoe and the foot.

Accordingly, one aspect of the present invention is to provide a foot and shoe protector including an enclosed toe portion shaped to substantially conform to and incase the toe area of a foot and a generally rectangular heelless sole portion attached along one edge to the enclosed toe portion.

Another aspect of the present invention is to provide a blank for forming a foot and shoe protector. The blank includes: a bottom toe portion shaped to substantially conform to the toe area of a foot; a generally rectangular heelless sole portion attached along one edge to said bottom toe portion; and a complementary upper toe portion.

These and other aspects of the present invention will become apparent to those skilled in the art after a reading of the following description of the preferred embodiment when considered with the drawings.

DESCRIPTION OF THE PREFERRED EMBODIMENTS

Figure 1:
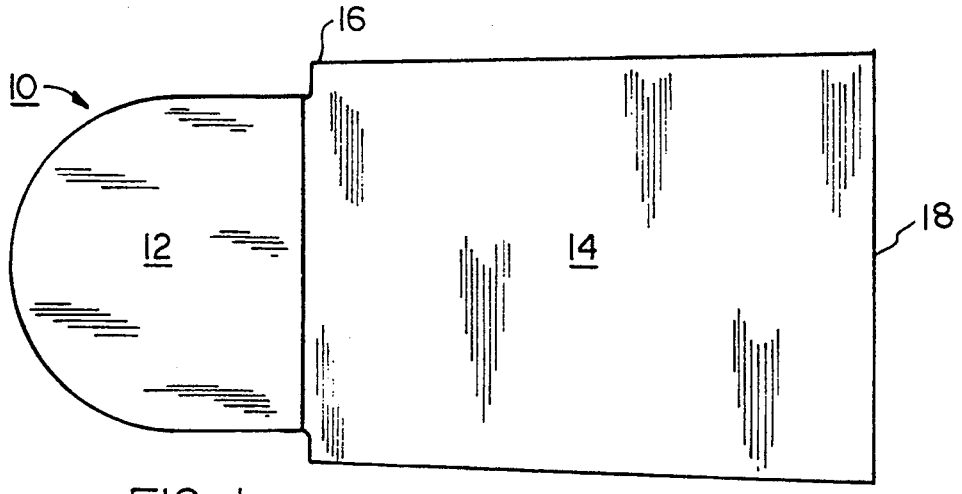
FIG. 1 is a top plan view of a foot and shoe protector constructed according to the present invention.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring to the drawings in general and FIG. 1 in particular, it will be understood that the illustrations are for the purpose of describing a preferred embodiment invention and are not intended to limit the invention thereto. As best seen in FIG. 1, a protective foot and shoe protector, generally designated 10, is shown constructed according to the present invention. The protective foot and shoe protector 10 includes an closed toe portion 12 and a generally rectangular sole portion 14. The outward extending edge 16 of sole 14 extends beyond and substantially parallel the outer edges of enclosed toe portion 12. The rear portion 18 of sole 14 is open. In the preferred embodiment, the foot and shoe protector 10 is formed of ¼-mil polyethylene. This is a non-absorbent plastic material which is tissue-thin so as not to be bulky in any noticeable degree when used by the customer to try on new shoes. Also, because it is smooth and no moisture comes in contact with the shoe, it allows the new shoes to slide on with ease and dispatch. Finally, because the rear portion 18 of the sole is open, one size fits all.

Figure 2:
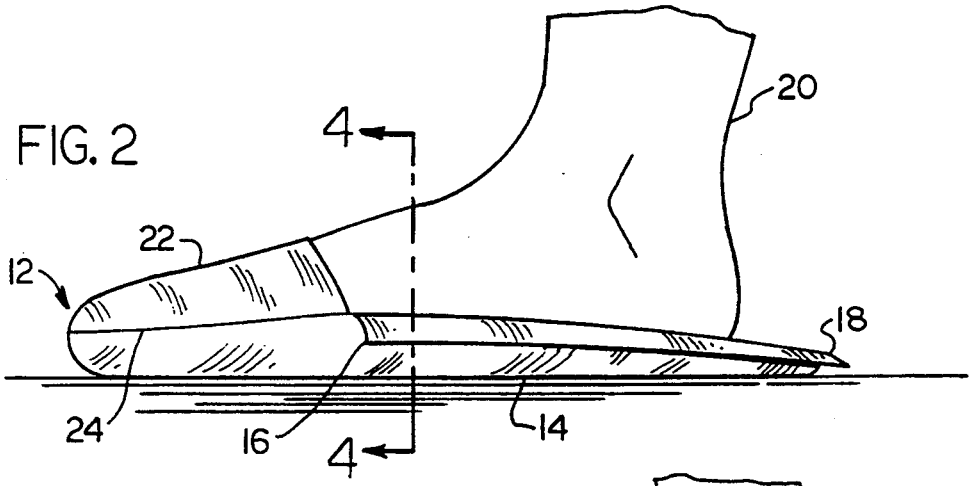
FIG. 2 is a side elevational view of the foot and shoe protector shown in FIG. 1 in use prior to putting on the shoe.
Figure 3:
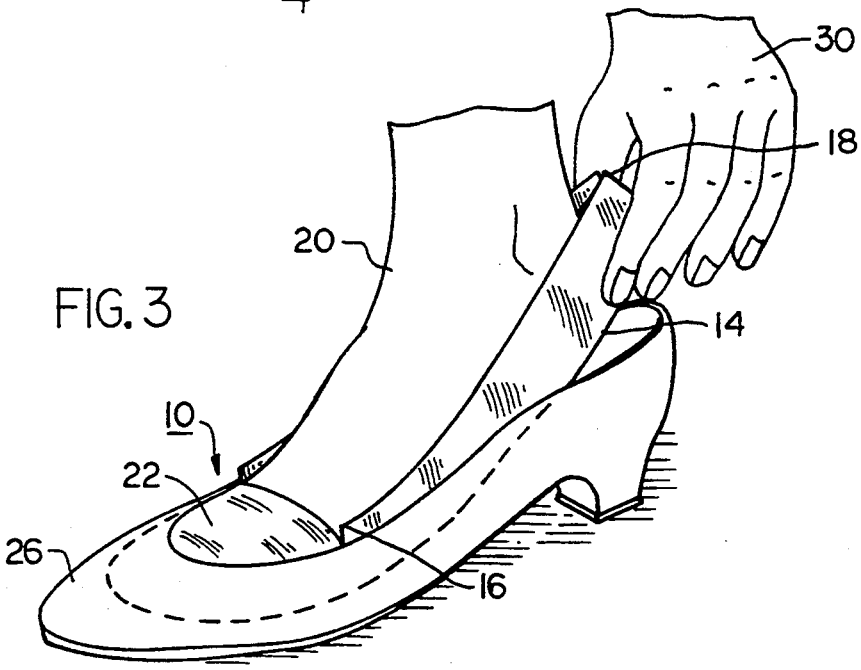
FIG. 3 is illustrative of the foot and shoe protector applied to the foot of a customer trying on a new shoe.

Turning to FIG. 2, there is shown a side elevational view of the foot and shoe protector shown in FIG. 1 in use prior to putting the shoe. As can be seen, the customer's foot 20 extends to the end of closed toe 12. Enclosed toe 12 is formed from an upper toe blank 22 which is attached to the lower toe portion formed by sole 14 by means of a seam or joint 24. Extended edge 16 forms a flap along the sides formed by sole portion 14. The folded edges of the rear portion 18 are held together by the customer or salesperson's hand 30. Accordingly, when the foot 20 is inserted into shoe 26, the flaps formed by extending edge 16 protect the shoe and foot from contact between each other and the rear edge 18 forms a heel portion enabling one size of the shoe protector 10 to fit all.

Figure 4:
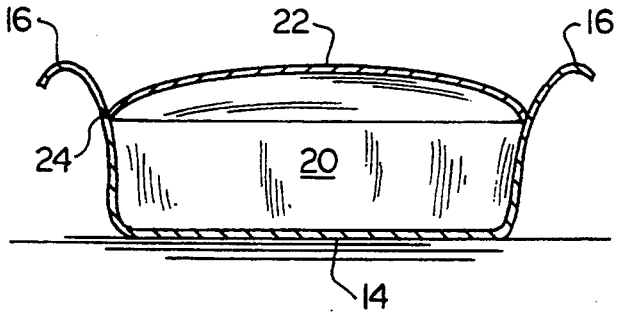
FIG. 4 is a sectional view of the foot and protector shown in FIG. 2 taken along lines 4—4.

The new construction of the foot and shoe protector 10 may best be seen in FIG. 4 which is a sectional view of the protector shown in FIG. 2 taken along lines 4—4. As can be seen, the outwardly extending edges 16 of sole 14 forms a flap which extends beyond seam 24. In addition, the portion of sole 14 adjacent to seam 24 forms sides to protect the sides of the foot and the sides of the shoe.

Figure 5:
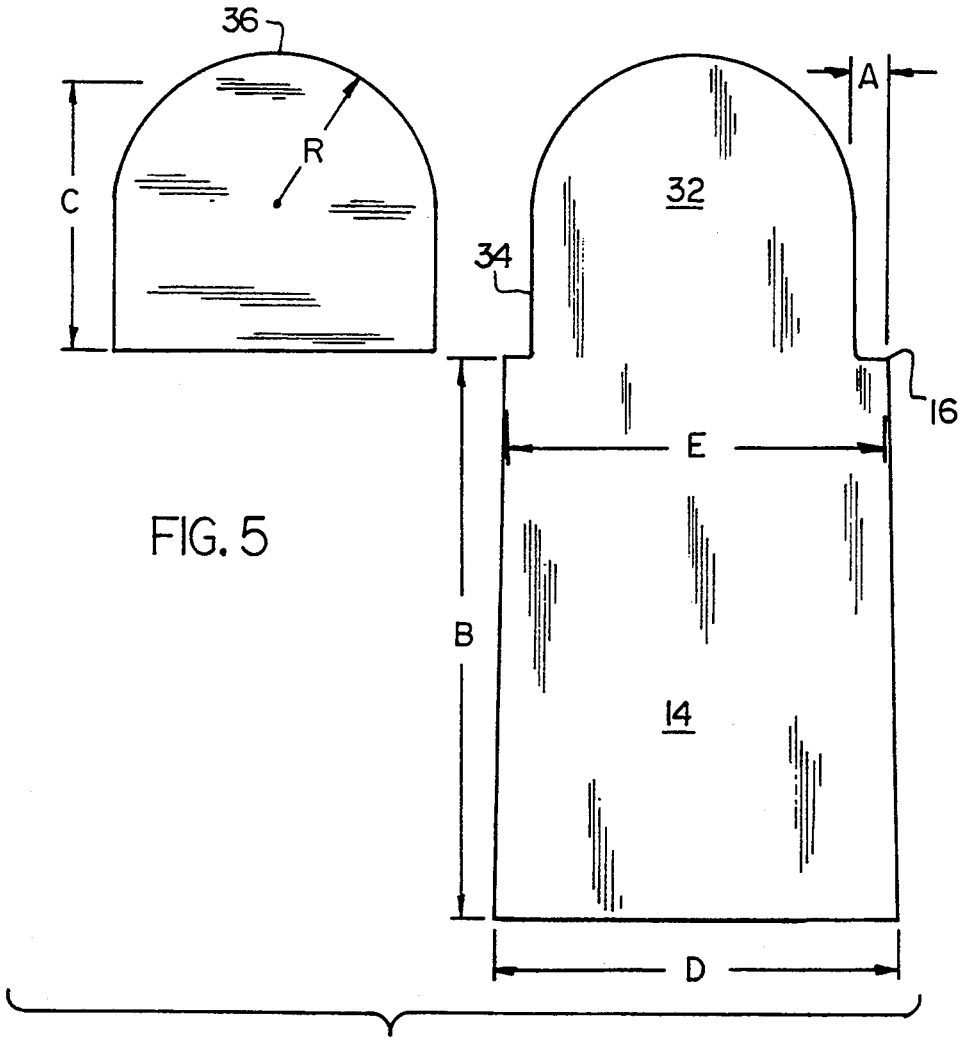
FIG. 5 is a top plan view of a blank useful for fabricating the foot and shoe protector shown in FIG. 1.

Finally turning to FIG. 5, there is shown a top plan view of a blank which can be used to fabricate the foot and shoe protector shown in FIG. 1. The blank consists of a sole portion 14 attached at one end to a complementary lower toe portion 32. The outwardly extending edge 16 of sole 14 is shown as dimension "A" which is about one-half inch. The overall length of the sole 14 is shown by dimension "B" which is approximately 7 inches. The overall length of the complementary toe portions shown by dimension "C" is about $4\frac{1}{2}$ inches. The width of the lower side of sole portion opposite complementary lower toe portion 32 is shown by dimension "D" which is about $6\frac{1}{4}$ inches. Finally, the width of the sole portion adjacent to complementary lower toe portion 32 shown by dimension "E" which is approximately $5\frac{5}{8}$ inches.

Both the upper and lower toe portions 22,32 consist of a straight line portion 32 and an arcuate portion 36 having a dimension shown by radius "R" of about $2\frac{3}{8}$ inches. Accordingly, it can be seen that the sole 14 is cut in a slightly trapezoidal shape with its base next to the heel. This provides additional material for the heel portion to ensure a better fit about foot 20. In practice upper and lower toe portions 22, 32 are heat welded together along seam 24 by conventional means to form foot and shoe protector 10.

Certain modifications and improvements will occur to those skilled in the art upon a reading of the foregoing description. By way of example, the toe portion could be closed by means of laser heating rather than conventional heating. It should be understood that all such modifications and improvements have been deleted herein for the sake of conciseness and readability but are properly within the scope of the following claims.

I claim:

1. A foot and shoe protector, said protector comprising:

(a) an enclosed toe portion shaped to substantially conform to and incase the toe area of a foot; and (b) a generally rectangular heelless sole portion attached along one edge to said enclosed toe portion, wherein said generally rectangular heelless sole portion attached along one edge to said enclosed toe portion extends beyond and substantially parallel to the outer edges of said toe portion from adjacent to the toe portion to the edge of the sole portion opposite the toe portion to form a pair of flaps for preventing contact between the upper edges of the shoe and the foot.

2. The protector according to claim 1, wherein said protector is formed from a recyclable material.

3. The protector according to claim 2, wherein said protector is formed from a thermoplastic resin.

4. The protector according to claim 3, wherein said protector is formed from polyethylene plastic.

5. The protector according to claim 1, wherein said protector is formed from a nonporous material.

6. The protector according to claim 5, wherein said protector is formed from $\frac{1}{4}$ mil polyethylene sheet.

7. The protector according to claim 1, wherein said protector is formed from an unitary construction.

8. The protector according to claim 1, wherein said generally rectangular heelless sole portion attached along one edge to said enclosed toe portion is trapezoidal-shaped with the base of said trapezoid being the edge of said sole opposite the edge of said sole attached to said enclosed toe portion.

9. A blank for forming a foot and shoe protector, said blank comprising:

(a) a bottom toe portion shaped to substantially conform to the toe area of a foot;

(b) a generally rectangular heelless sole portion attached along one edge to said bottom toe portion, wherein said generally rectangular heelless sole portion attached along one edge to said bottom toe portion extends beyond and substantially parallel to the outer edges of said bottom toe portion from adjacent to the bottom toe portion to the edge of the sole portion opposite the bottom toe portion to form a pair of flaps for preventing contact between the upper edges of the shoe and the foot; and (c) a complementary upper toe portion.

10. The blank according to claim 9, wherein said blank is formed from a recyclable material.

11. The blank according to claim 10, wherein said blank is formed from a thermoplastic resin.

12. The blank according to claim 11, wherein said blank is formed from polyethylene plastic.

13. The blank according to claim 9, wherein said blank is formed from a nonporous material.

14. The blank according to claim 13, wherein said blank is formed from $\frac{1}{4}$ mil polyethylene sheet.

15. The blank according to claim 9, wherein said generally rectangular heelless sole portion attached along one edge to said enclosed toe portion is trapezoidal-shaped with the base of said trapezoid being the edge of said sole opposite the edge of said sole attached to said enclosed toe portion,

* * * * *